US005373701A

United States Patent [19]

Siefering et al.

[11] Patent Number: 5,373,701

[45] Date of Patent: Dec. 20, 1994

[54] CRYOGENIC STATION

[75] Inventors: Kevin L. Siefering, Cary; Walter H. Whitlock, Chapel Hill, both of N.C.

[73] Assignee: The BOC Group, Inc., New Providence, N.J.

[21] Appl. No.: 88,454

[22] Filed: Jul. 7, 1993

[51] Int. Cl.[5] ..... F17C 9/02

[52] U.S. Cl. ..... 62/48.1; 62/50.2; 62/50.4; 62/50.5

[58] Field of Search ..... 62/48.1, 50.2, 50.4, 62/50.5

[56] References Cited

U.S. PATENT DOCUMENTS

| | | | |
|---|---|---|---|
| 1,773,140 | 8/1930 | Heylandt | 62/48.3 |
| 1,953,467 | 4/1934 | Dana | 62/48.1 |
| 2,037,673 | 4/1936 | Zenner | 62/1 |
| 2,089,558 | 3/1909 | Karwat | 62/175.5 |
| 2,219,673 | 10/1940 | Zenner | 62/1 |
| 2,260,357 | 10/1941 | Zenner | 62/48.1 |
| 2,436,781 | 2/1948 | White | 62/1 |
| 2,479,070 | 8/1949 | Hansen | 62/1 |
| 2,502,184 | 3/1950 | Thayer | 62/1 |
| 2,729,068 | 1/1956 | Mitchell | 62/1 |
| 2,770,951 | 11/1956 | Morrison | 62/1 |
| 2,842,942 | 7/1958 | Johnston et al. | 62/50 |
| 2,951,348 | 9/1960 | Loveday et al. | 62/50.4 X |
| 3,003,007 | 10/1961 | Newsome, Jr. | 260/676 |
| 3,097,497 | 7/1963 | Fitt | 62/50.4 |
| 3,166,913 | 1/1965 | Carter | 62/78 X |
| 3,392,537 | 7/1968 | Woerner | 62/50 |
| 3,750,414 | 8/1973 | Heftman | 62/51.1 X |
| 3,797,262 | 3/1974 | Eigenbrod | 62/48.1 |
| 3,798,918 | 3/1974 | Maher et al. | 62/40 |
| 4,280,499 | 7/1981 | Squazzi | 62/50.2 X |
| 4,299,091 | 11/1981 | Carter et al. | 62/48.1 |
| 4,607,489 | 8/1986 | Krongold | 62/48.1 |
| 4,620,962 | 11/1986 | Brodbeck | 422/24 |
| 4,668,488 | 5/1987 | Ranke et al. | 423/210 |
| 4,727,723 | 3/1988 | Durr | 62/54 |
| 5,111,666 | 5/1992 | Klok et al. | 62/48.1 |
| 5,121,609 | 6/1992 | Cieslukowski | 62/50.4 |
| 5,127,230 | 7/1992 | Neeser et al. | 62/7 |
| 5,144,806 | 9/1992 | Frenzel et al. | 62/9 |
| 5,148,681 | 9/1992 | Lagache | 62/48.1 |

FOREIGN PATENT DOCUMENTS

| | | | |
|---|---|---|---|
| 2542421 | 9/1984 | France | 62/48.1 |
| 2753495 | 6/1979 | Germany | 62/48.1 |
| 1019160 | 5/1983 | U.S.S.R. | 62/47.1 |

*Primary Examiner*—Christopher Kilner

*Attorney, Agent, or Firm*—David M. Rosenblum; Larry R. Cassett

[57] ABSTRACT

A cryogenic station for delivering a cryogen substantially free of higher boiling impurities. The cryogenic station includes an insulated main tank and an auxiliary tank. Liquid stored in the main tank and pressurized by a pressure building circuit is driven into the auxiliary tank. Cryogenic vapor formed in the auxiliary tank is warmed to ambient temperature by an external heat exchanger and is then recirculated back to an internal heat exchanger located within the auxiliary tank. The internal heat exchanger is configured such that a portion of the cryogen driven into the auxiliary tank is vaporized to form the cryogenic vapor and a remaining portion of such cryogen is left within the auxiliary tank to substantially retain the higher boiling impurities in a solidified state. As such, the cryogenic vapor is substantially free from the impurities when delivered as a product stream.

4 Claims, 1 Drawing Sheet

FIG.
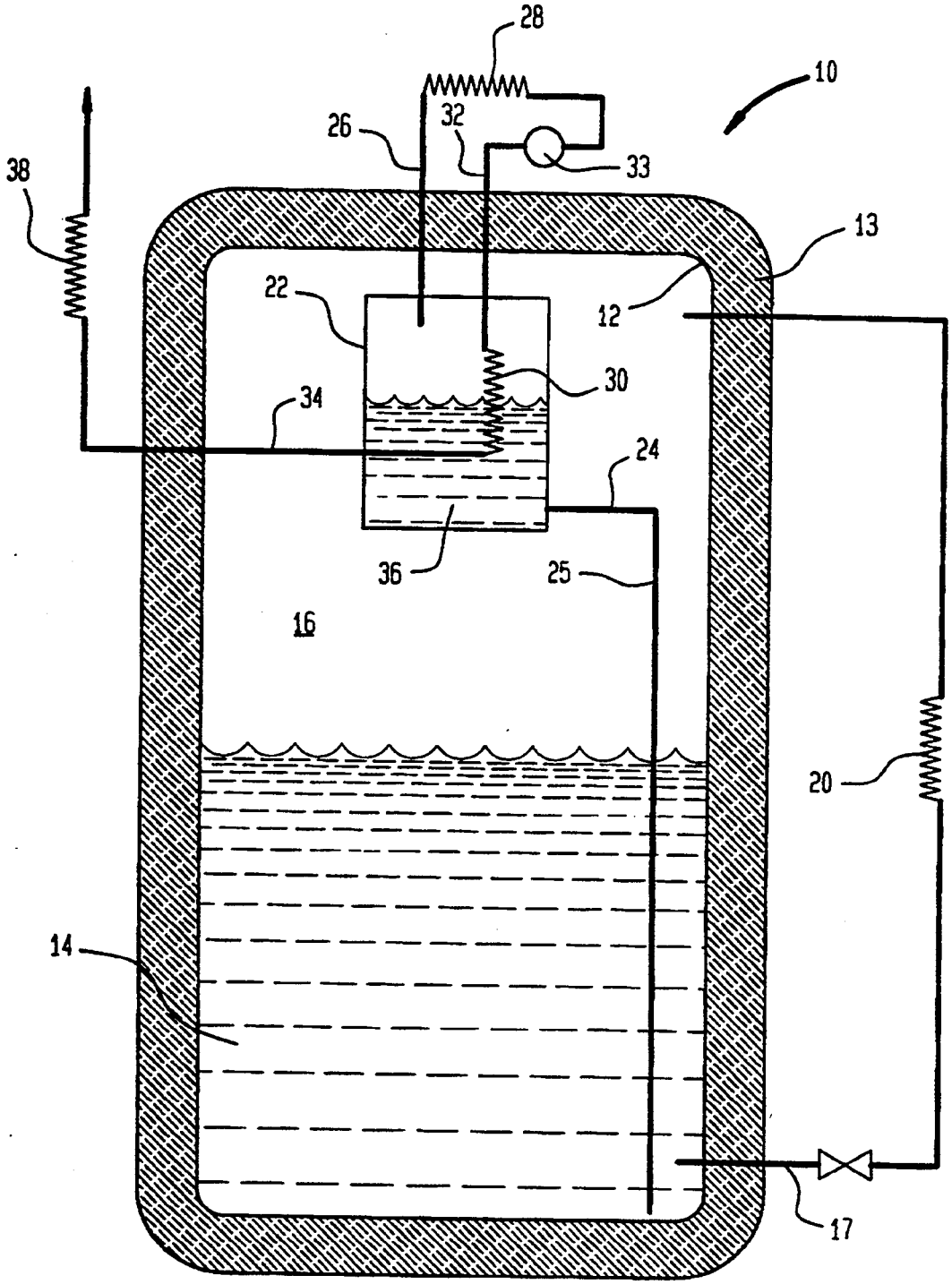

CRYOGENIC STATION

BACKGROUND OF THE INVENTION

The present invention relates to a cryogenic station for delivering a cryogen substantially free of higher boiling impurities such as carbon dioxide and moisture. More particularly, the present invention relates to such a cryogenic station in which the cryogen is vaporized within an auxiliary tank under equilibrium conditions such that the higher boiling impurities are substantially retained within the cryogen in a solidified state and the cryogenic vapor formed upon vaporization of the cryogen is thereby substantially free of the higher boiling impurities.

A requirement exists in various industries for storage and delivery of cryogenic gases free of higher boiling impurities. This need is particularly acute in the electronics industry. In the electronics industry, various ultra-high purity atmospheric gases are used in the manufacture of semiconductor devices. Such ultra-high purity atmospheric gases are stored in a liquid cryogenic state within cryogenic stations for eventual delivery as a cryogenic vapor. Such cryogenic stations consist of an insulated storage tank having a pressure building circuit. Liquid from the bottom of the storage tank is vaporized in a pressure building coil of the pressure building circuit and the vapor is subsequently introduced into the head space of the tank in order to pressurize the tank to a delivery pressure. Gaseous product, initially in the form of a cryogenic liquid, is delivered from the tank at the delivery pressure to an ambient temperature heat exchanger in order to vaporized the product and warm it to ambient temperature.

The higher boiling impurities, that is impurities that boil at temperatures above the boiling temperature of the cryogen, such as moisture and carbon dioxide, initially solidify within the cryogen, but eventually vaporize along with the cryogen. As a result, the impurities are delivered from the tank along with the product.

As will be discussed hereinafter, the present invention provides a cryogenic station for delivering a cryogen substantially free of the higher boiling impurities.

SUMMARY OF THE INVENTION

The present invention provides a cryogenic station for delivering a cryogen substantially free of higher boiling impurities. As used herein and in the claims, the term "cryogen" means a volatile fluid that is normally a gas at atmospheric temperatures and pressures, for instance, nitrogen. The term "higher boiling impurities" as used herein and in the claims means impurities having a boiling point above the boiling temperature of the cryogen.

The cryogenic station comprises an insulated main tank adapted to be filled with the cryogen as a liquid such that a top head space region is formed above a level of the liquid. A pressure building circuit is connected to the insulated main tank for pressurizing the insulated main tank to a delivery pressure. An auxiliary tank having a bottom inlet is connected to the insulated main tank such that a quantity of the liquid is driven into the auxiliary tank under impetus of the delivery pressure. The auxiliary tank is also provided with a top outlet for discharging cryogenic vapor. At least one external heat exchanger, in communication with the top outlet of the auxiliary tank, is provided for warming the cryogenic vapor to ambient temperature. At least one internal heat exchanger is located within the auxiliary tank. The at least one internal heat exchanger has an inlet conduit in communication with the ambient heat exchanger and a discharge conduit extending through the auxiliary tank for discharging the cryogenic vapor.

The at least one internal heat exchanger is configured such that a portion of the quantity of the liquid driven into the auxiliary tank vaporizes to form the cryogenic vapor and a remaining portion of the quantity of the liquid is left within the auxiliary tank to substantially retain the higher boiling impurities in a solidified state. As a result, the cryogenic vapor is discharged from the auxiliary tank substantially free of the higher boiling impurities.

BRIEF DESCRIPTION OF THE DRAWINGS

While the specification concludes with claims distinctly pointing out the subject matter that applicants regard as their invention, it is believed that the invention will be better understood when taken in connection with the accompanying drawings in which the sole figure is a schematic of a cryogenic station in accordance with the present invention.

DETAILED DESCRIPTION

With reference to the figure, a cryogen station 10 is illustrated, which for sake of explanation will be described as storing nitrogen of ultra-high purity. As could be appreciated by those skilled in the art, cryogenic station 10 could be used for storing other substances in a cryogenic form and the present invention is not limited to the storage of liquid nitrogen. For instance, cryogenic station 10 could be used to store liquid helium, liquefied natural gases and etc.

Cryogenic station 10 consists of an insulated main tank 12 sheathed in vacuum insulation 13. Main tank 12 is adapted to be filled with liquid nitrogen 14 such that a top head space region 16 is formed above the level of liquid nitrogen 14. Main tank 12 is additionally provided with a bottom outlet 17. Attached to bottom outlet 17 is a pressure building circuit 18 of conventional design employing a pressure building coil 20. Liquid nitrogen 14 enters pressure building circuit 18 and is vaporized. The vapor is introduced into top head space region 16 to pressurize main tank 12 to a delivery pressure.

Cryogenic station 10 is also provided with an auxiliary tank 22 located within top head space region 16 of main tank 12. Auxiliary tank 22 has a bottom inlet in the form of an inlet conduit 24 which extends from an outlet line 25 to bottom outlet 17 of main tank 12. Additionally, auxiliary tank 12 is provided with a top outlet in the form of a top outlet line 26, extending through main tank 12, for discharging cryogenic vapor. In operation, a quantity of liquid nitrogen 14 is driven under impetus of the delivery pressure out of bottom outlet 17 of main tank 12, through outlet line 25 and inlet conduit 24 and thereby into auxiliary tank 22. Concurrently, cryogenic vapor is discharged from top outlet line 26 of auxiliary tank 22.

An external heat exchanger 28 is connected to top outlet line 26 for heating the cryogenic vapor to ambient temperature. An internal heat exchanger 30, located within auxiliary tank 22, is provided with an inlet conduit 32 passing through both main tank 12 and auxiliary tank 22 and connected to external heat exchanger 28. As will be discussed, an electric heater 33 can optionally be interposed between external heat exchanger 28 and internal heat exchanger 30. Internal heat exchanger 30 can, as illustrated, be formed by a vertically oriented coil of tubing. Internal heat exchanger 30 is also provided with a discharge conduit 34 passing through both auxiliary tank 22 and main tank 12 for discharging the cryogenic vapor.

Internal heat exchanger 30 is designed in a manner well known in the art to have a surface area just sufficient to vaporize a portion of the quantity of liquid nitrogen 14 being driven into auxiliary tank 22 and thereby leave a remaining portion 36 of the quantity of liquid nitrogen 14. The portion of the quantity of liquid nitrogen 14 vaporized within auxiliary tank 22 forms the cryogenic vapor. Although a portion of the higher boiling impurities may vaporize along with the liquid nitrogen, the higher boiling impurities will by and large instantaneously re-solidify within remaining portion 36 of liquid nitrogen 14 to be retained therein in a solidified state. As such, the cryogenic vapor discharged from discharge conduit 34 is substantially free of the higher boiling impurities.

An ambient heat exchanger 38 can also be provided to heat the cryogen vapor to ambient temperature, thereby to form a product stream. As illustrated, ambient heat exchanger 38 is connected to discharge conduit 34 of internal heat exchanger 30.

Depending upon the service to which the invention is applied, it may be necessary to provide two passes of heat exchange utilizing two external and internal heat exchangers 28 and 30. In such case cryogenic vapor would flow from one external heat exchanger 28 to one internal heat exchanger 30 (as described above) and would subsequently pass through another external heat exchanger 28 and another internal heat exchanger 30 instead of being discharged to discharge conduit 34. The cryogenic vapor would then be discharged from such other heat exchanger 30 to an ambient heat exchanger such as ambient heat exchanger 38.

As can be appreciated, auxiliary tank 22 could be a separate tank located outside of main tank 12. In such case, it would have to have its own vacuum insulation. Such possible embodiment would add to the complexity involved in fabricating a cryogenic station in accordance with the present invention. As mentioned above, electric heat 33 is optional. In very cold climates, though, ambient conditions might not supply sufficient heat to external heat exchanger 28 to cause the requisite vaporization of the quantity of liquid nitrogen 14 supplied to auxiliary tank 22. In such case, electric heater 33 (preferably weather-proof electrically heated pipe) would have to be provided. Although not illustrated, auxiliary tank 22 could be equipped with a liquid drain line and control valve which could be used periodically to drain the accumulated solid impurities from auxiliary tank 22.

While the invention has been illustrated in relation to a preferred embodiment, it will be understood by those skilled in the art that numerous additions, omissions and changes may be made without departing from the spirit and scope of the present invention.

We claim:

1. A cryogenic station for delivering a cryogen substantially free of higher boiling impurities, said cryogenic station comprising:

an insulated main tank adapted to be filled with the cryogen as a liquid such that a top head space region is formed above a level of the liquid;

a pressure building circuit connected to the insulated main tank for pressurizing the insulated main tank to a delivery pressure;

an auxiliary tank having a bottom inlet connected to the insulated main tank such that a quantity of the liquid is driven into the auxiliary tank under impetus of the delivery pressure and a top outlet for discharging cryogenic vapor;

at least one external heat exchanger in communication with the top outlet of the auxiliary tank for warming the cryogenic vapor to ambient temperature; and at least one internal heat exchanger located within the auxiliary tank and having an inlet conduit in communication with the ambient heat exchanger and a discharge conduit extending through the auxiliary tank for discharging the cryogenic vapor;

the at least one internal heat exchanger configured such that a portion of the quantity of the liquid driven into the auxiliary tank vaporizes to form the cryogenic vapor and a remaining portion of the quantity of the liquid is left within the auxiliary tank to substantially retain the higher boiling impurities in a solidified state, whereby the cryogenic vapor discharged from the auxiliary tank is substantially free of the higher boiling impurities.

2. The cryogenic station of claim 1, wherein:

said auxiliary tank is located within the top head space region of said main tank;

the inlet and discharge conduits of the at least one internal heat exchanger also extend through the main tank; and the top outlet of the auxiliary tank comprises a top outlet line passing through the main tank and connected to the at least one external heat exchanger.

3. The cryogenic station of claim 2, further comprising an ambient heat exchanger connected to the discharge conduit to re-heat the cryogenic vapor to ambient temperature.

4. The cryogenic station of claims 1 or 2 or 3, further comprising electric heater means interposed between the at least one external heat exchanger and the at least one internal heat exchanger for further heating the cryogenic vapor.

* * * * *